US007081711B2

(12) United States Patent
Glidden et al.

(10) Patent No.: US 7,081,711 B2
(45) Date of Patent: Jul. 25, 2006

(54) INDUCTIVELY GENERATED STREAMING PLASMA ION SOURCE

(75) Inventors: Steven C. Glidden, Freeville, NY (US); Howard D. Sanders, Ithaca, NY (US); John B. Greenly, Lansing, NY (US)

(73) Assignee: Applied Pulsed Power, Inc., Ithaca, NY (US)

( * ) Notice: Subject to any disclaimer, the term of this patent is extended or adjusted under 35 U.S.C. 154(b) by 48 days.

(21) Appl. No.: 10/974,622

(22) Filed: Oct. 27, 2004

(65) Prior Publication Data

US 2005/0088101 A1 Apr. 28, 2005

Related U.S. Application Data

(60) Provisional application No. 60/515,050, filed on Oct. 28, 2003.

(51) Int. Cl.
*H01J 7/24* (2006.01)

(52) U.S. Cl. ..... 315/111.51; 315/111.81; 156/345.48

(58) Field of Classification Search ..... None
See application file for complete search history.

(56) References Cited

U.S. PATENT DOCUMENTS

| | | | | |
|---|---|---|---|---|
| 4,583,710 | A | 4/1986 | Adams et al. | 251/129.1 |
| 4,596,687 | A | 6/1986 | Dagenhart | 376/130 |
| 5,525,805 | A | 6/1996 | Greenly | 250/423 R |
| 5,532,495 | A | 7/1996 | Bloomquist et al. | 250/492.21 |
| 5,656,819 | A | 8/1997 | Greenly | 250/423 R |
| 6,664,548 | B1 | 12/2003 | Benveniste et al. | 250/423 P |
| 6,696,793 | B1 | 2/2004 | Yamashita | 315/111.81 |
| 6,717,155 | B1 | 4/2004 | Zschornack et al. | 250/396 R |
| 6,724,160 | B1 | 4/2004 | Kaufman et al. | 315/500 |
| 6,734,434 | B1 | 5/2004 | Sainty | 250/423 |
| 2004/0079485 | A1 * | 4/2004 | Lee et al. | 156/345.48 |
| 2004/0129673 | A1 * | 7/2004 | Belyansky et al. | 216/67 |

* cited by examiner

*Primary Examiner*—David Vu
(74) *Attorney, Agent, or Firm*—Brown & Michaels, PC

(57) ABSTRACT

A novel pulsed, neutralized ion beam source is provided. The source uses pulsed inductive breakdown of neutral gas, and magnetic acceleration and control of the resulting plasma, to form a beam. The beam supplies ions for applications requiring excellent control of ion species, low remittance, high current density, and spatial uniformity.

16 Claims, 8 Drawing Sheets

INDUCTIVELY GENERATED STREAMING PLASMA ION SOURCE

REFERENCE TO PROVISIONAL APPLICATION

This application claims an invention which was disclosed in Provisional Application No. 60/515,050, filed Oct. 28, 2003, entitled "INDUCTIVELY GENERATED STREAMING PLASMA ION SOURCE". The benefit under 35 USC §119(e) of the U.S. provisional application is hereby claimed, and the aforementioned application is hereby incorporated herein by reference.

ACKNOWLEDGMENT OF GOVERNMENT SUPPORT

This invention was made with Government support under Grant No. DE-FG02-01ER83147, awarded by the Department of Energy. The government has certain rights in the invention.

FIELD OF THE INVENTION

The invention pertains to the field of ion beam sources. More particularly, the invention pertains to sources for pulsed neutralized ion beams which are used in areas such as material modifications, fusion energy research, and space propulsion.

BACKGROUND OF THE INVENTION

A neutralized ion beam is a stream of ions with directed velocity, accompanied by an equal charge density of electrons that produces a type of net charge-neutral streaming plasma. Such neutral plasma streams allow much higher ion current density to be transported than can be transported with space-charge dominated bare ion beams.

There are many different methods used to create neutralized ion beams. There are continuous generation methods, creating steady streams of ions, and pulsed methods, creating small bursts of ions.

These sources have two basic mechanisms. The first is the creation of the ions from a non-ionic source. The second is the acceleration of the ions in a directed beam. The methods for the creation of ions can be from electric field or thermal effects. Either method results in the separation of one or more electrons from atomic or molecular elements, thus creating an ionized state. The acceleration of the ions can be caused by application of electrostatic or time dependant magnetic fields.

One class of ion sources uses a voltage potential applied between two electrodes to generate an electric field. Free electrons are accelerated by the electric field and collide with gas molecules resulting in a partially ionized gas. Often these sources use thermal effects, such as a hot filament, to increase the number of free electrons available for the ionization process.

The electric field across the partially ionized gas may add a directed velocity component to the thermal velocity of the ions, while a magnetic field may be used to focus the ion flow into a beam. Some of these sources are able to run continuously at low currents, others operate pulsed at higher currents. Sources with some of these basic characteristics are described in U.S. Pat. Nos. 6,734,434, 6,724,160, 6,717,155, and 6,696,793 respectively. For many high current applications, sources which use electrodes may not be suitable, because electrodes have a limited lifetime, may require cooling, and introduce impurities into the plasma. On the other hand, a hot filament requires a separate power supply and also has a limited lifetime.

Another type of source uses a high frequency RF transmitter with the antenna immersed in the neutral gas. The electric field component of the transmitted electromagnetic wave is used to break down the gas into plasma. This type of ion source is disclosed in U.S. Pat. No. 6,664,548. Typically, the percentage of ionization increases gradually over many cycles before the desired level is obtained. This type of source is most suitable for steady state applications.

Another type of source is inductively driven using one or more coils located near the neutral gas. The coils are driven by one or more half cycles of oscillating current. The induced electric field produced by the changing magnetic field is used to break down the gas while the magnetic field can be used to accelerate the resulting plasma. If a localized pulsed gas source is used, the ions can be accelerated away from the neutral gas, resulting in filly ionized plasma moving with a well defined leading edge. An example of a pulsed ion beam source is described in U.S. Pat. No. 5,525,805, with additional material covered in U.S. Pat. Nos. 5,656,819 and 5,532,495. Inductively driven sources eliminate the need for electrodes. For rapid ionization of gasses at low pressure with purely inductively driven sources, high rates of change in the driving current are required to produce sufficient inductive electric field for rapid, complete ionization.

All of the above examples use gas as the supply of the molecules to be broken down into ions. Other possibilities are sublimed molecules from heated solids and liquids. In all cases, the supply is generated by a pulsed or steady flow method. The supply can be near or in the breakdown region or maintains a constant background pressure of the neutral molecules in the breakdown region.

One method for generating a pulsed gas supply is to use a fast gas valve. One example, which describes a fast gas valve operated by pulsing electromagnetic coils to move a magnetic metal disk, is described in U.S. Pat. No. 4,583,710. Another valve, a fast gas valve which uses induced magnetic fields to move a non-magnetic metal disk, is described in U.S. Pat. No. 5,525,805. This type of fast valve opens and closes faster than the electromagnetic valves, but some of them have problems which reduce the quality and lifetime of the valve. In those valves, a conical metal disk was held against a seal providing an annular puff of gas. However, due to material property differences, clamping forces, adhesion forces, and other factors, one could not be assured of a uniform gas density around the annular puff. Also, deflection of the metal disk results in metal fatigue, which can limit the lifetime of the disk.

A neutral beam intensity controller is described in U.S. Pat. No. 4,596,687. Neutral beams are beams of neutral atoms, not the net-neutral ionized plasma of equal populations of free electrons and ions described in this invention, which is described in detail infra. Neutral beams are produced by charge-exchange of an un-neutralized ion beam passing through a neutral gas cell. U.S. Pat. No. 4,596,687 describes a method of controlling the current in a neutral beam by magnetic deflection of the ion beam as it enters the neutralizing gas cell. An amplitude-modulated, rotating magnetic field is applied to deflect the ions in a controlled manner to achieve the desired intensity control of the neutral beam along the beam axis at constant beam energy. The magnetic field deflects the orbits of the individual ions in the gas neutralizer before they charge-exchange to become neutral atoms, so that the peak intensity of the neutral beam is deflected away from an exit aperture downstream of the gas cell. As the magnetic deflection is increased, more of the neutrals miss the exit aperture, and the neutral beam intensity passing out through the aperture is reduced.

Therefore, it is desirous to have an improved plasma ion source in which the prior art systems' shortcomings are overcome.

SUMMARY OF THE INVENTION

The present invention provides a pulsed ion beam source which uses inductive electric fields for ionizing a low pressure gas and time-varying magnetic fields for accelerating the resultant plasma into a high current, low emittance neutralized ion beam with a velocity along a desired direction and a controllable pulse shape. The source includes a set of coils for generating the electric and magnetic fields.

The present invention provides a pre-ionization method which decreases the required electric field for prompt ionization of the neutral gas thereby increasing the efficiency of the ion source. This pre-ionization method includes a pre-ionization coil which is inductively coupled to the set of coils. The pre-ionization coil possesses a gap, for generating seed electrons, coupled in series with a high impedance circuit element, for limiting the current through the gap.

The present invention provides a modulator for shaping of the neutralized ion beam pulse, the modulator including a set of coils having electric current flowing therein.

The present invention provides a nozzle for shaping the neutral gas pulse, the nozzle disposed at a proximity to the set of coils to create a reservoir for the gas subject to ionization.

The present invention provides a tank circuit for efficiently transferring the energy from the power supply to the set of coils. The tank circuit includes the set of coils in parallel with a capacitance.

The present invention provides a fast needle valve, which uses a current through a coil generating a pulsed magnetic field that does not fully penetrate a metallic plate connected to the needle, thereby opening the valve.

Accordingly, a streaming plasma ion source with a pre-ionization coil is provided. The source includes: a power supply; a gas supply positioned upstream of the source; a set of coils receiving power from the power supply for conveying an energy for ionization of a gas and acceleration of the resultant plasma, and being insulated from the plasma; and a pre-ionization coil, a wire coil with a gap in series with a high impedance circuit element and inductively coupled thereto, for receiving the energy for ionization.

Accordingly, a streaming plasma ion source with a modulator is provided. The source includes: a power supply; a gas supply position upstream of the source; a set of coils receiving power from the power supply for conveying an energy for ionization of a gas and acceleration of the resultant plasma, and being insulated from the plasma; and a modulator for shaping of the resultant neutralized ion beam pulse, the modulator including a set of coils having electric current flowing therein.

Accordingly, a streaming plasma ion source with a nozzle is provided. The source includes: a power supply; a gas supply position upstream of the source; a set of coils receiving power from the power supply for conveying an energy for ionization of a gas and acceleration of the resultant plasma, and being insulated from the plasma; and a nozzle disposed at the proximity of the set of coils to create a reservoir for the gas subject to ionization.

Accordingly, a streaming plasma ion source with a tank circuit is provided. The source includes: a power supply; a gas supply position upstream of the source; a set of coils receiving power from the power supply for conveying an energy for ionization of a gas and accelerating the resultant plasma, and being insulated from the plasma; and a tank circuit comprising a capacitance positioned in parallel with the inductance of the set of coils for receiving a supply of energy and outputting the same for ionization and acceleration.

Accordingly, a streaming plasma ion source with a fast needle valve is provided. The source includes: a power supply; a gas supply position upstream of the source wherein the gas supply comprises a fast needle valve, which uses a current through a coil generating a pulsed magnetic field that does not fully penetrate a metallic plate connected to the needle thereby opening the valve; and a set of coils receiving power from the power supply for conveying an energy for ionization of a gas and accelerating the resultant plasma, and being insulated from the plasma.

A streaming plasma ion source is provided. The source includes: a power supply; a gas supply position upstream of the source wherein the gas supply comprises a fast needle valve, which uses a current through a coil generating a pulsed magnetic field that does not fully penetrate a metallic plate connected to the needle thereby opening the valve; a set of coils receiving power from the power supply for conveying an energy for ionization of a gas and acceleration of the resultant plasma, and being insulated from the plasma; a modulator for shaping of the resultant neutralized ion beam pulse, the modulator including a set of coils having electric current flowing therein; a nozzle disposed at the proximity of the set of coils to create a reservoir for the gas subject to ionization; a tank circuit comprising a capacitance in parallel with the inductance of the set of coils for receiving a supply of energy and outputting the same for ionization and acceleration; and a pre-ionization coil being a wire coil with a gap positioned in series with a high impedance circuit element and inductively coupled thereto, for receiving the energy for ionization.

DETAILED DESCRIPTION OF THE INVENTION

This section includes the descriptions of the present invention including the preferred embodiment of the present invention for the understanding of the same. It is noted that the embodiments are merely describing the invention. The claims section of the present invention defines the boundaries of the property right conferred by law.

Figure 1:
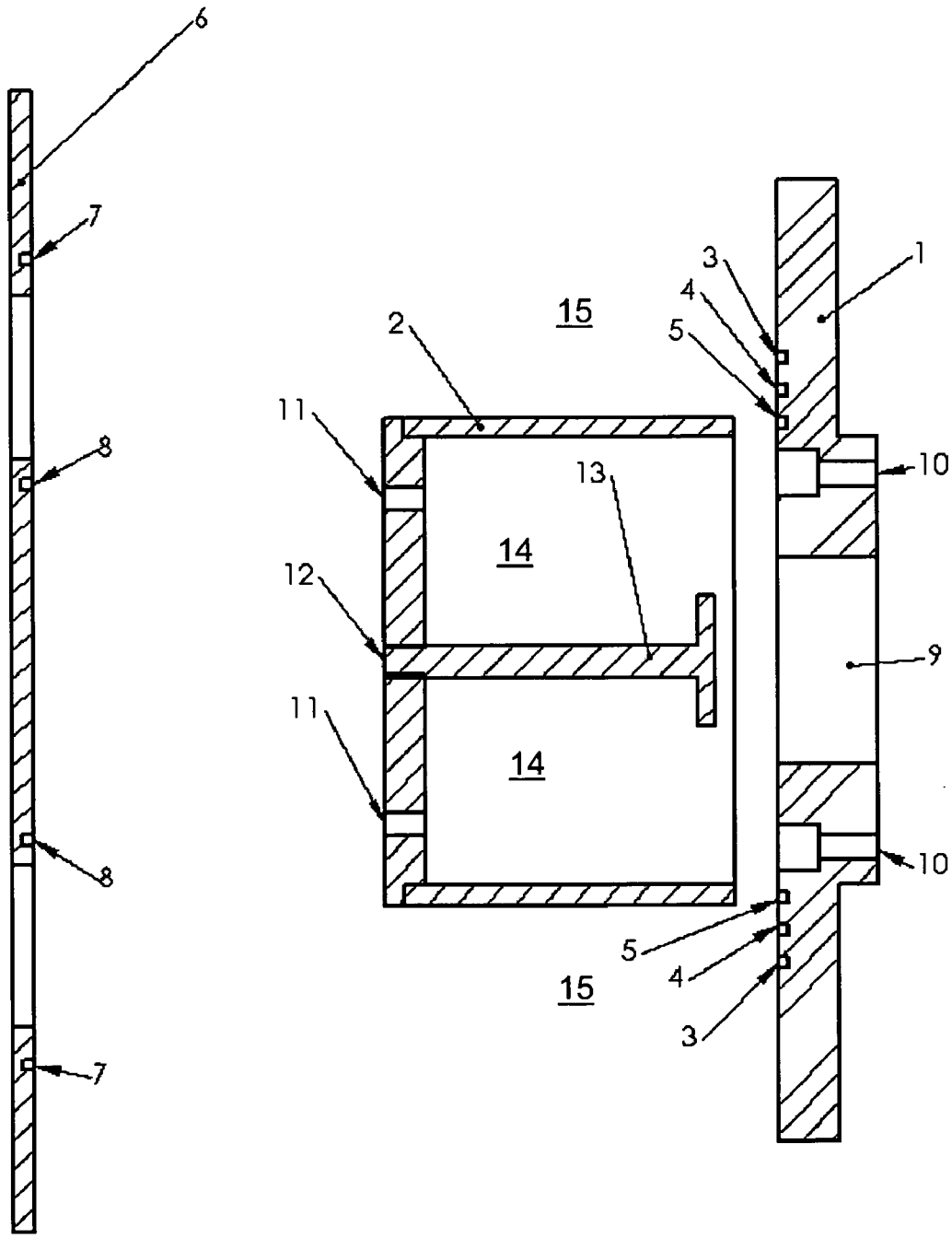
FIG. 1 shows a section cut side view of the plasma ion source.
Figure 2:
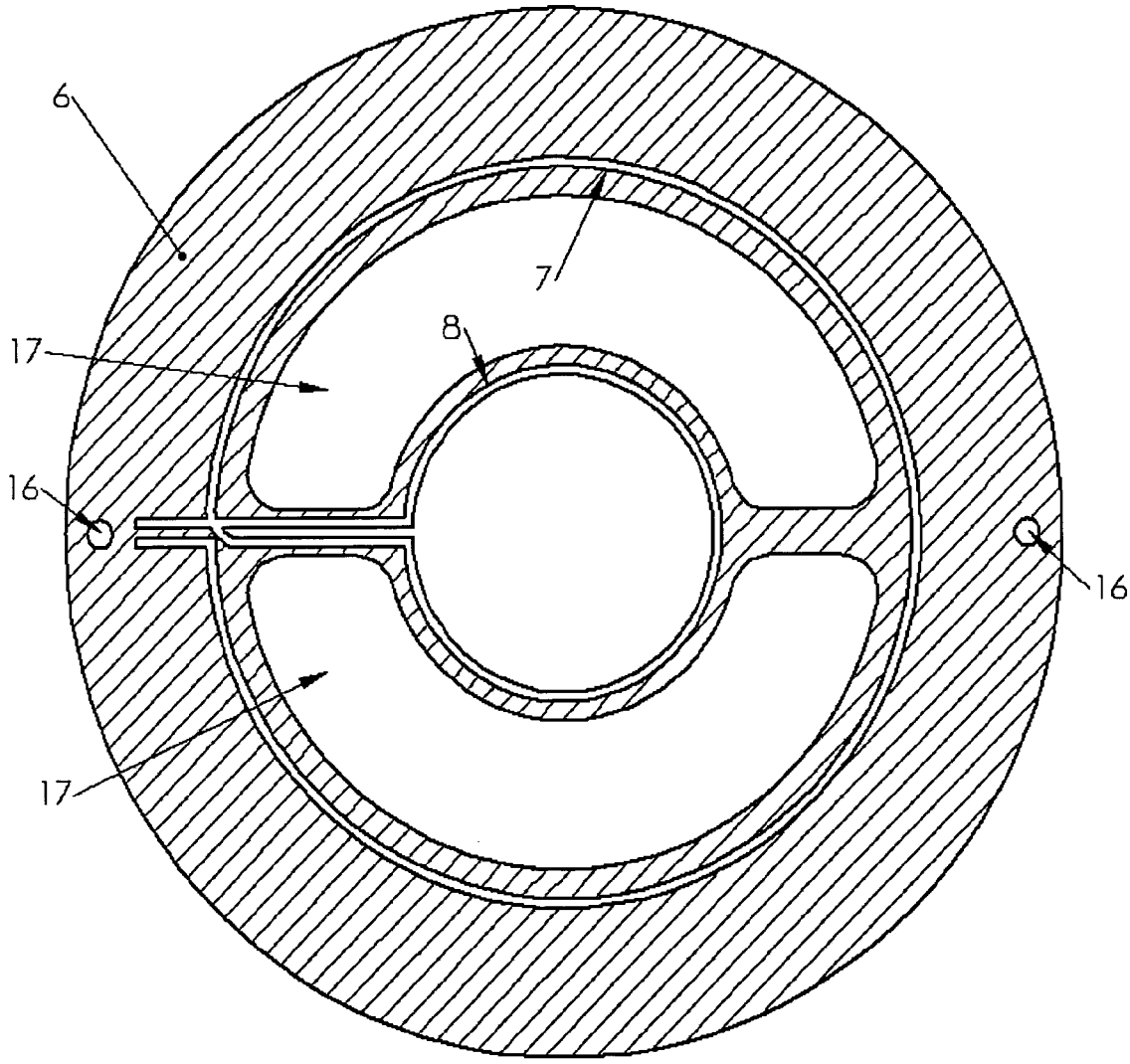
FIG. 2 shows a front view of the modulator plate.

Referring to FIGS. 1–8, specifically referring now to FIG. 1 wherein the basic structure of the inductively generated streaming plasma ion source of the present invention is depicted. The source comprises a backplane 1, a nozzle 2, and a modulator 6. The backplane 1 includes a set of coils 3, 4, 5, mounting holes 10, and a place or region to insert a gas supply 9. The nozzle 2 is shaped like a cup with a set of mounting holes 11, 12 or outer mounting holes 11 and central mounting holes 12 on the bottom or a first side of nozzle 2. The outer mounting holes 11 are used to mount the nozzle 2 onto a member. The central mounting hole 12 is used to mount additional components inside the nozzle 2 as needed. For example, one such component is a gas diverter 13, which is used to redirect gas from an axial puff into an annular puff originating from gas supply 9.

The modulator 6 also contains a set of coils 7, 8. Also refer to FIG. 2, the mounting holes 16 and a more detailed depiction of the modulator coil 7, 8, locations on the modulator 6 are shown.

Gas released from the gas supply 9 flows out into the nozzle 2, where the gas flows in all directions at the same rate. Gas not flowing out radially along the backplane 1 will be contained by the reservoir 14 created by the nozzle 2 in which reservoir 14 is enclosed. The present invention teaches the controlling of the spacing between the nozzle 2 and the backplane 1, as well as the inner and outer diameters and lengths of the nozzle 2. The effect is that the present invention teaches the controlling of the profile of the gas density versus time at locations in front of the backplane 1, outside the radius of the nozzle 2. In other words, the present invention controls the profile of the gas density versus time at region 15 outside nozzle 2. The gas subject to ionization exits the nozzle 2, and then travels past the coils 3, 4, 5, on the backplane 1.

The innermost coil 5, is used as a pre-ionization coil. The coil 5 is a wire with a gap 102. In series with the gap 102 is a capacitor 90, which limits the current able to flow within the wire. A first voltage is induced across the gap 102 by the oscillating magnetic field created by the driving coils 3, 4. This first voltage across gap 102 creates seed electrons, which aid in the breakdown of neutral gas into plasma. Controlling the capacitance 90 and the width of the gap 102 as well as the diameter of the coil 5, controls the amount of seed electrons generated while limiting the current and thereby greatly reducing lifetime concerns for the electrodes 104 at the edges of the gap 102. It is known that the amount of electrons in neutral gas at room temperature is insufficient for initiating rapid ionization. The present invention provides more free electrons allowing rapid ionization.

Figure 6:
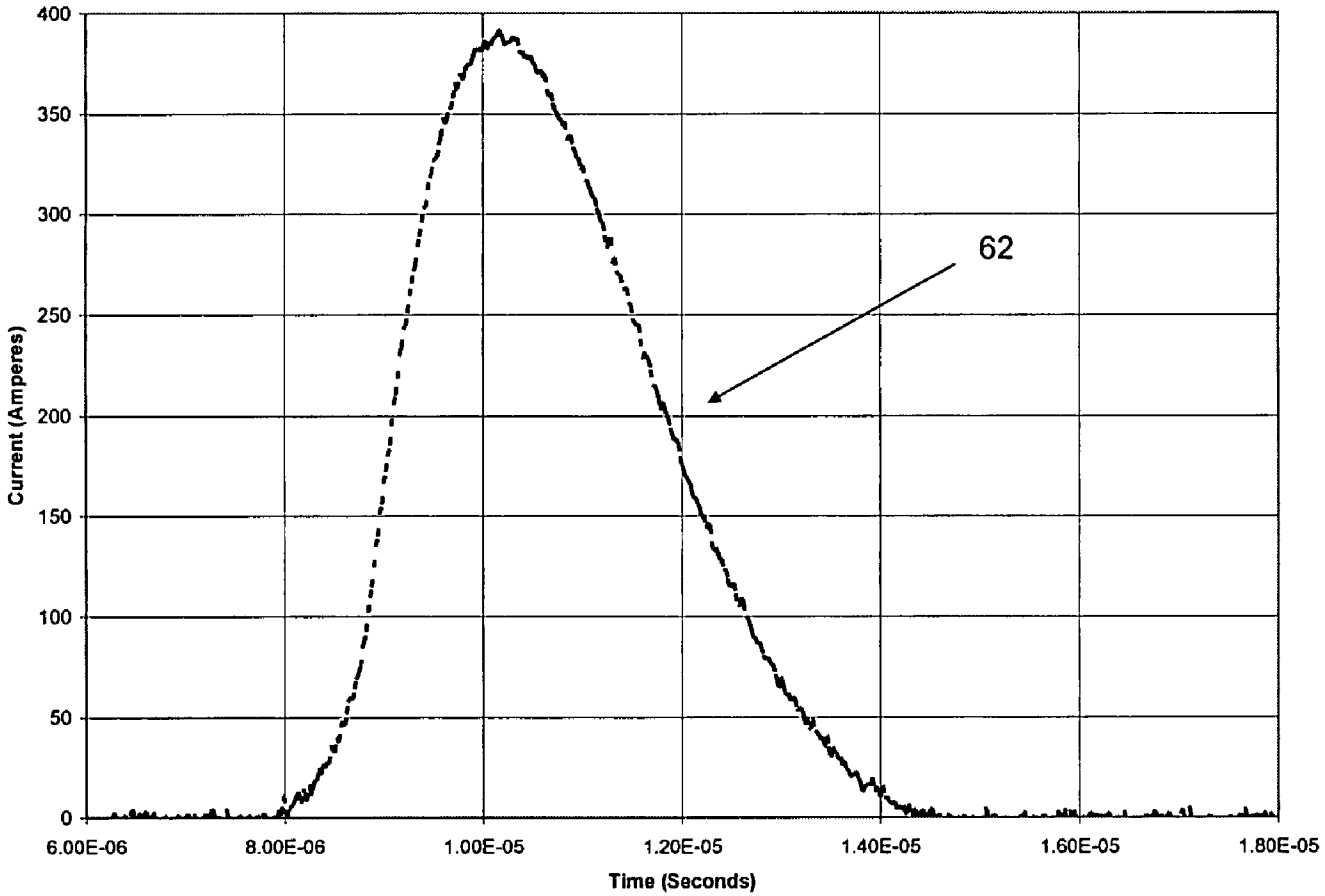
FIG. 6 shows the current through the modulator coils.

The seed electrons travel out into the neutral gas in front of the driving coils 3, 4, on the backplane 1. While only two coils 3, 4 are shown, any number of coils such as coil 3, 4 may be used. These coils may be connected in series. A capacitance 73 may be coupled in series with the coils. Wires in the driving coils 3, 4 are connected in series with the current 60, shown in FIG. 5, traveling in the same direction in all driving coils 3, 4. This oscillating current 60 generates oscillating electric and magnetic fields. The circuit voltage 61, also shown in FIG. 6, is the voltage across the capacitance 73. In addition, voltage 61 is proportional to the rate of change of the current 60, multiplied by the inductance of the tank circuit 71. The magnetic field is proportional to the current 60, in the driving coils 3, 4. This oscillating magnetic field induces voltage 61 across the gap 102 in the pre-ionization coil, 5. The voltage in the space between the driving coils 3, 4, is equal to the total electric potential 61, across all the coils 3, 4, divided by the number of coils. This electric field working on free electrons, initiated by the seed electrons generated by the pre-ionization coil 5, breaks down the neutral gas into plasma by ionizing collisions between the accelerated electrons and the neutral gas. The charged particles, ions and electrons, comprising the plasma are then accelerated by the oscillating magnetic field.

The acceleration drives the plasma away from the driving coils 3, 4. The acceleration occurs because the plasma conductivity becomes high, thereby allowing a plasma current to be induced by the oscillating magnetic field. This induced plasma current in the applied, oscillating magnetic field generates the repulsive force which accelerates the plasma away from the driving coils 3, 4.

The streaming plasma moves downstream past the nozzle 2, towards the modulator 6. As the plasma approaches the modulator, current 62 from a current source, shown in FIG. 6, is driven into the wires in the coils 7, 8 of the modulator 6. This current again generates electric and magnetic fields. These fields act on the plasma like a valve, restricting or preventing flow of plasma through the gaps 17 in the modulator 6. By controlling the timing and shape of the current of the coils 7, 8, modulator 6 controls the profile of the ion current passing through the modulator 6.

Figure 3:
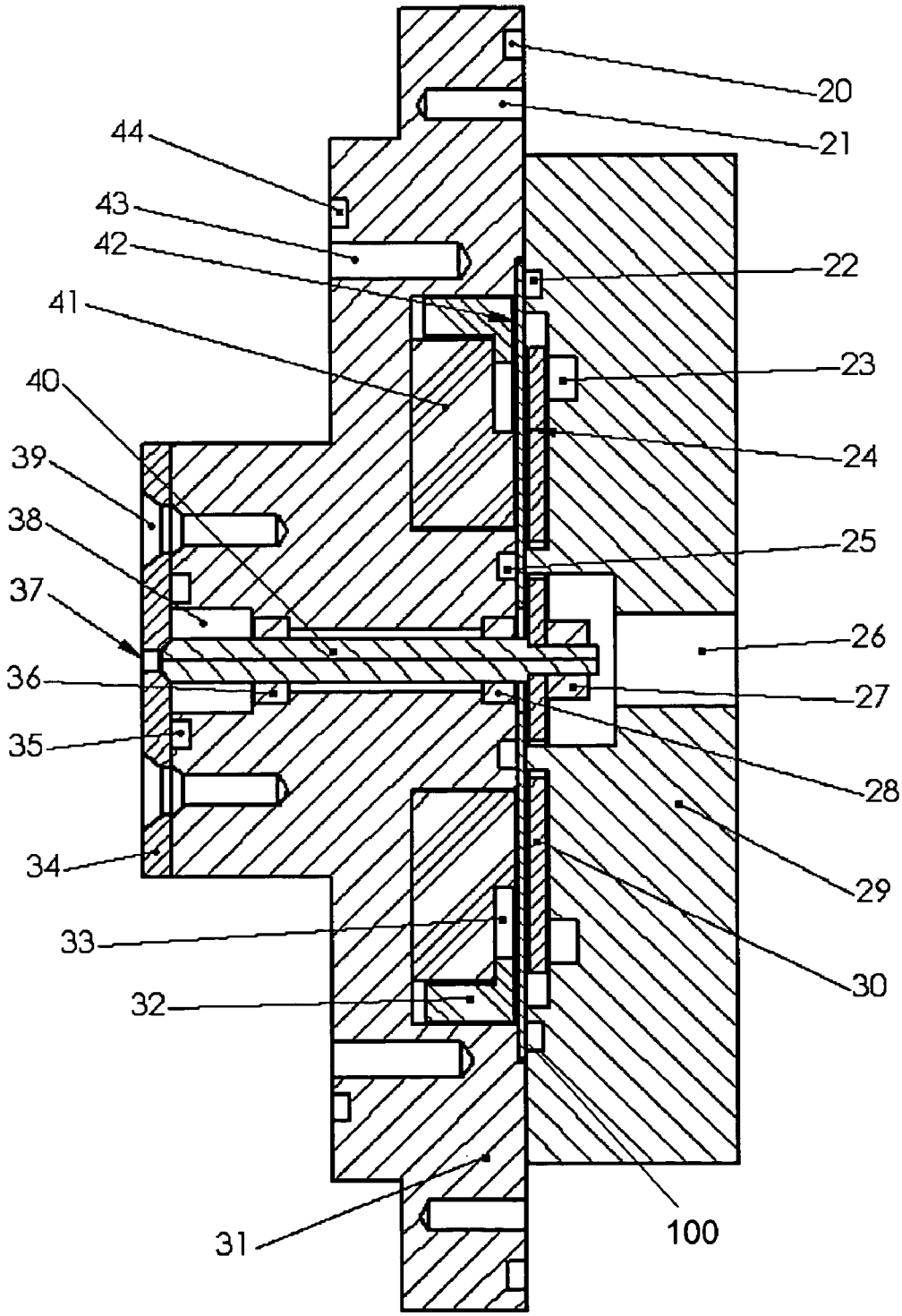
FIG. 3 shows a section cut side view of the axial gas puff valve.

Referring specifically to FIG. 3, an example of a gas supply using the axial puff valve is shown. The body of the valve includes a two piece body, a rear section 29 and a forward section 31. The valve is a fast needle valve using a stem 40, which is sealed against a plate 34 for controlling the gas flow. The plate 34 is sealed by an o-ring 35 to the forward body section 31 by affixing means such as screws 39. The plate 34 can be made of plastic or polymer materials such as Teflon or metal, provided a sufficient seal can be obtained between the end of the stem, 40 and the plate 34. An alternative method would be to make the plate 34 out of two pieces comprising a first piece comprising layer of plastic and a second piece comprising layer of metal. The seal is then disposed between the stem 40 and the plastic layer with the metal layer providing structural strength in order to prevent the sealing force from deforming the plastic. The stem 40 is attached to a non-magnetic, highly electrically conductive, metal disk 30 by attaching means such as a nut 27. The axial motion of the stem 40 is controlled by bearings 28, 36, located in the forward body section, 31. A spring 23 between the metal disk 30 and the rear body section 29 forces the stem 40 against the plate 34. The control coil 33 is held by an inner coil form 41 and an outer coil form 32. Both the inner coil form 41 and the outer coil form 32 are disposed inside the forward body section 31, under a metal cover 42. The two coil forms 32, 41, are made of a non-conducting material. The area in the forward body section 31 under a metal cover 42 is sealed by o-rings 22, 25 for separation from the gas supply area 26 disposed in the rear body section 29. The metal cover 42 is made from a material penetrable to magnetic field, such as titanium. When a current pulse flows through the control coil 33, the magnetic field generated by the current pushes the metal disk 30 away from the control coil 33, thereby compressing the spring, 23. The current pulse causes the stem 40 to move away from the plate 34, thereby allowing gas located in a second reservoir 38 to escape through the exit, 37. The metal disk 30 bounces off the rear body section 29, but quickly returns the stem 40 to the previous position before the current pulse is applied, thereby sealing against the plate 34 as before. The opening time of the valve is controlled by various elements including the distance of the gap 100 between the forward and rear body sections 29, 31 the pulse width and amplitude of the current pulse, the force generated by the spring 23, and the mass of the stem 40, metal disk 30, and nut 27. An elastomer 24 over the metal cover 40 prevents the metal disk 30 from bouncing which assures the valve only opens once per current pulse. The reservoir 38 is then refilled by a channel between the stem 40 and the forward body section 31 from the gas supply entrance 26 in the rear body section 29. The valve is designed to be used in pulsed operation. Either the forward o-ring 44 or the rear o-ring 20 using blind tapped holes 21, 43 seal the valve in the source.

Figure 4:
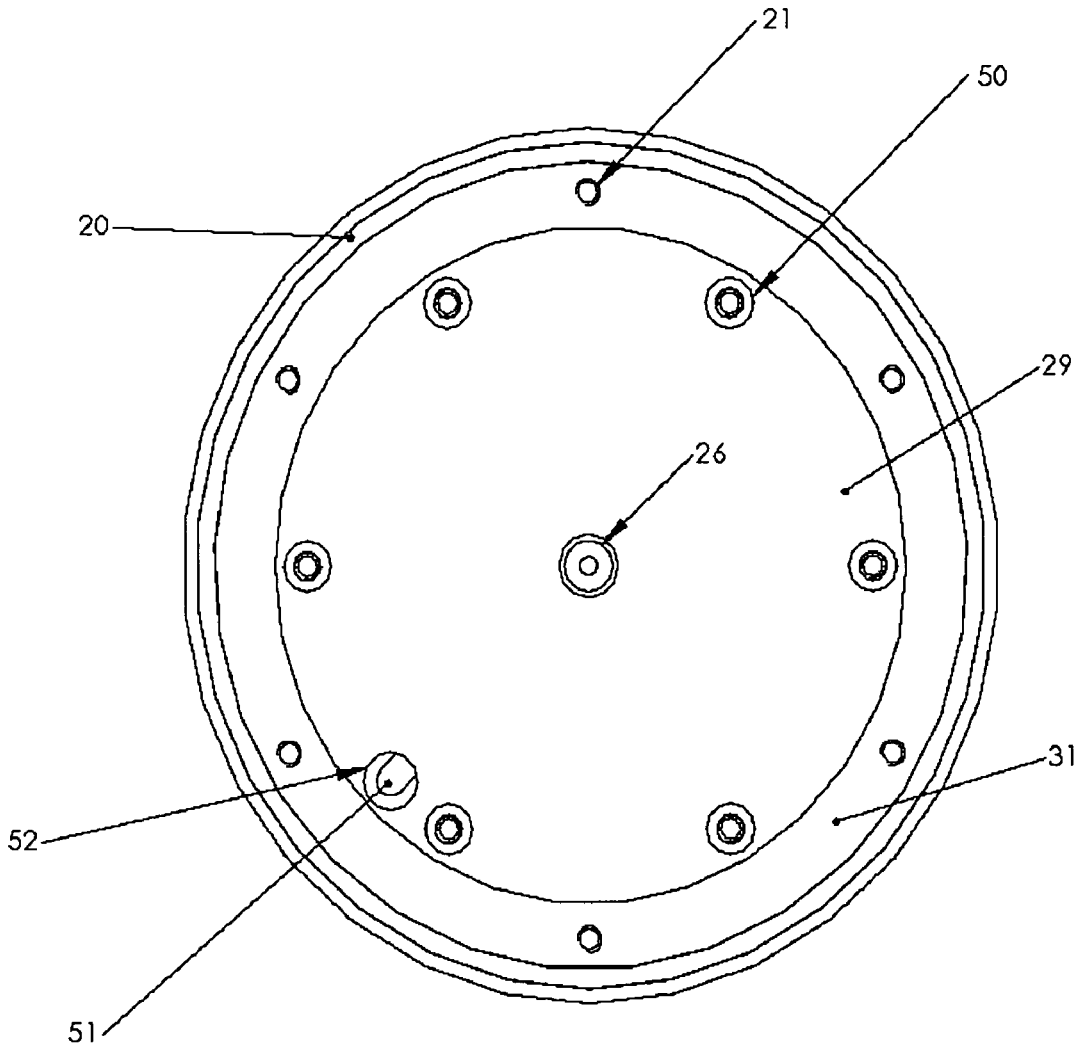
FIG. 4 shows a back view of the axial gas puff valve.
Figure 5:
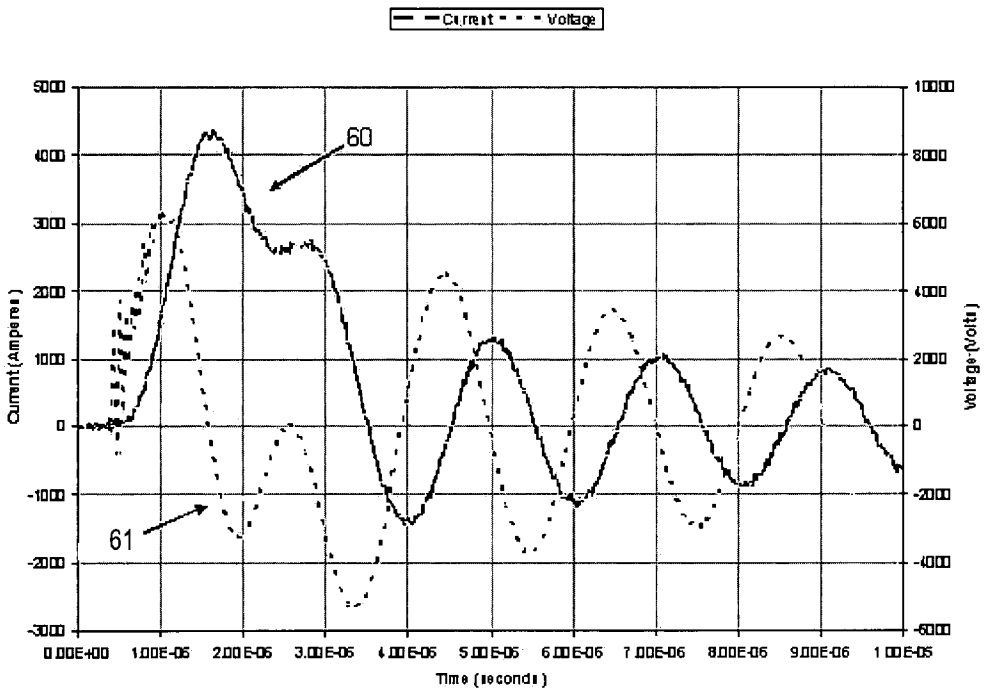
FIG. 5 shows the current through the driver coils.

FIG. 4 shows a recess 51 in the forward body section 31 and an opening 52 in the rear body section 29, which are used to connect the control coil 33 to the control circuit. This opening or hole 52 allows the control coil 33 to be in standard atmosphere rather than having to encapsulate the control coil 33 to allow it to be in vacuum. This feature significantly eases the assembly and manufacturing of the valve. Also shown are a set of holes 50 for attaching the front body section 31 to the rear body section 29.

Figure 7:
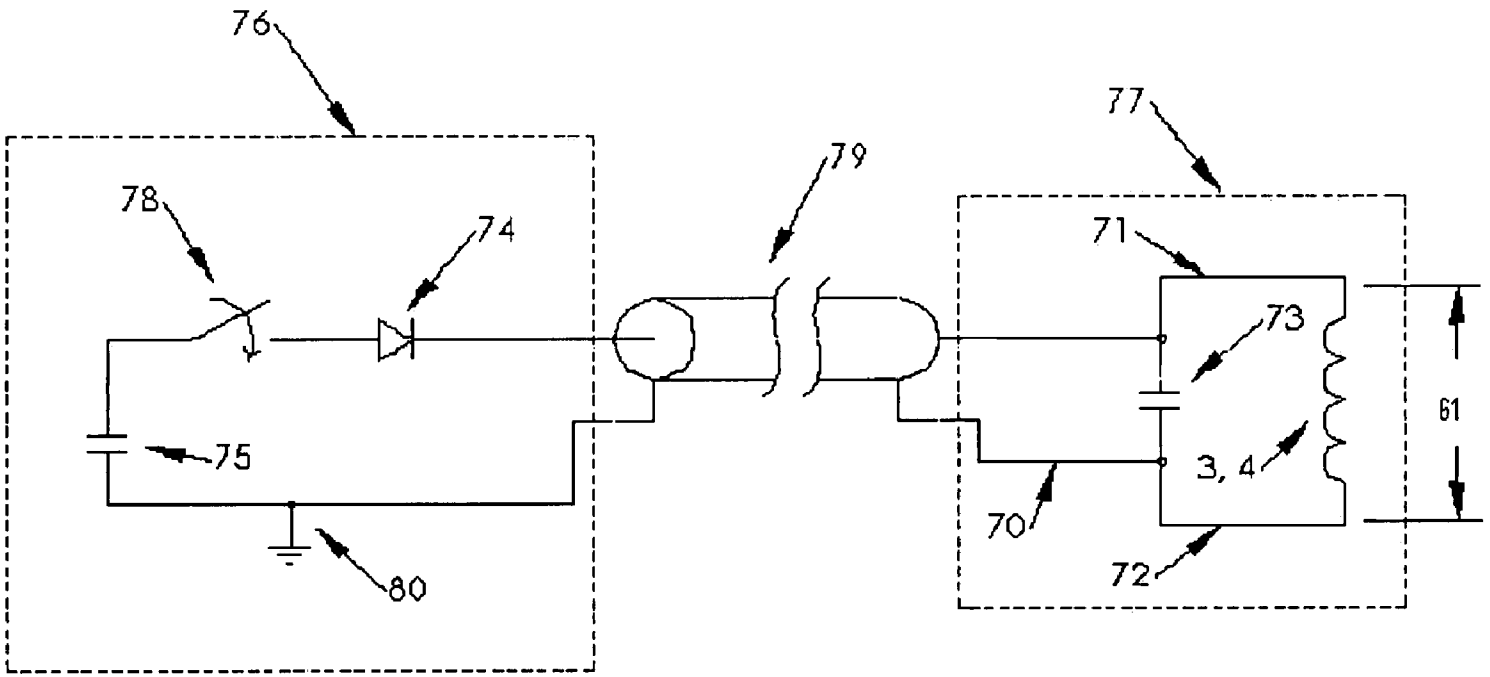
FIG. 7 shows a simplified circuit schematic for the plasma ion source.

A simplified electrical schematic of the driver circuit is shown in FIG. 7. The driver circuit includes a pulsed power circuit 76 connected via a coaxial cable 79 to a tank circuit 77. The pulsed power circuit 76 comprises a pulsed power supply 75, which can be a capacitor connected to a high voltage DC power supply, a switch, 78, which may be a solid state switch, and diodes 74. The driver circuit has a single point electrical ground connection 80 in the pulsed power circuit 76. The tank circuit 77 includes a tank capacitor 73, and the driver coils 3, 4. The driver current 60 is measured at the return current path 70 using a Rogowski. The induced electric potential 61 across the driver coils 3, 4 is measured across the tank circuit 71, 72. The diodes 74 and the inductance of the coaxial cable 79 prevent the energy injected into the tank circuit 77 from returning back to the pulsed power supply 75.

Figure 8:
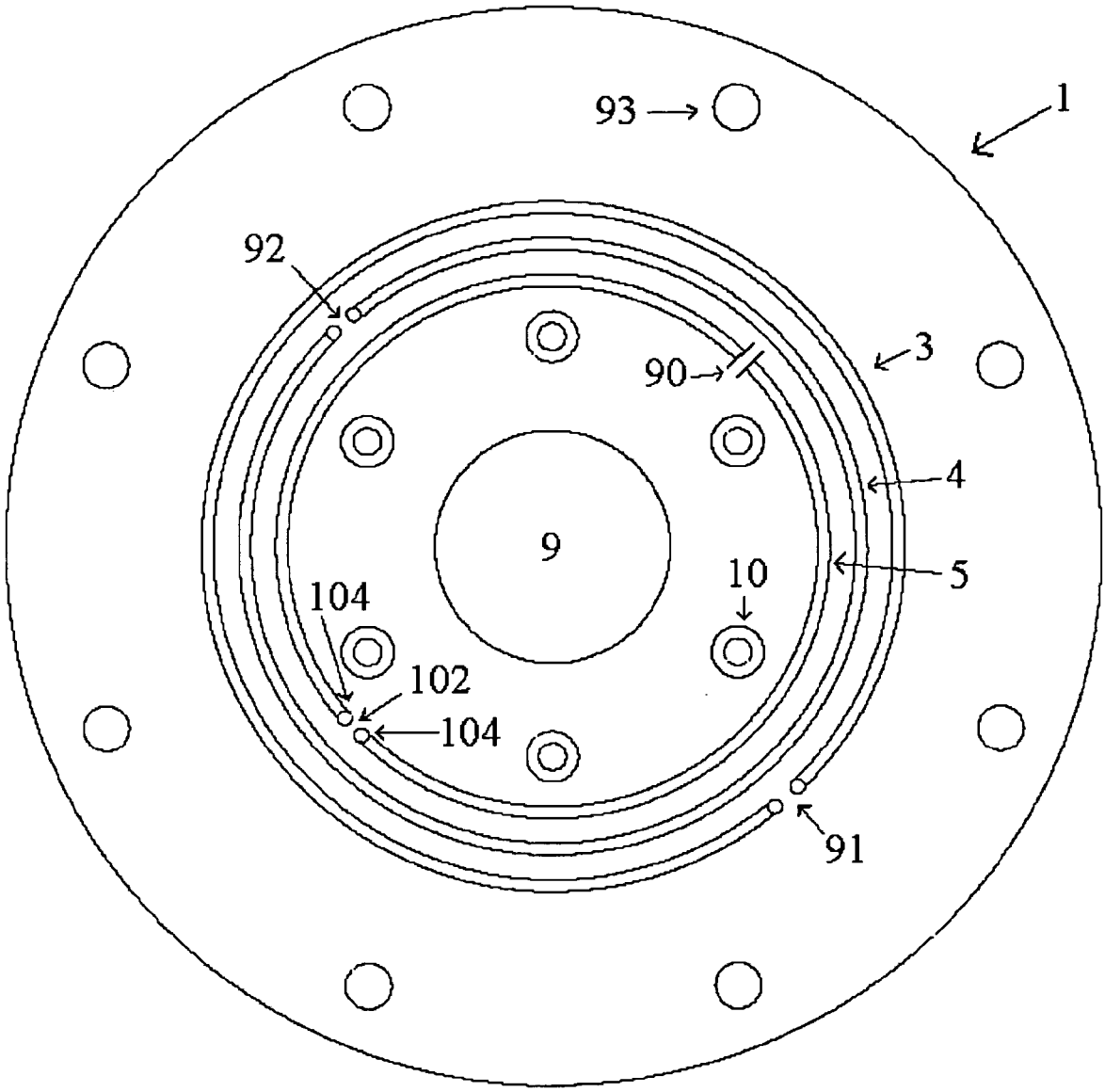
FIG. 8 shows a set of coils inductively coupled to a separate coil.

Referring specifically to FIG. 8, a schematic depiction of the coils 3, 4, 5 is shown. Coils 3, 4, 5 may be positioned on a plane such as backplane 1. Coil 3 and coil 4 are electrically coupled in series and insulated by suitable insulation materials. Capacitance 73 (see FIG. 7) is coupled to the coils 3, 4 for oscillatively discharging inputted energy stored therein. Coil 5 may be disposed concentrically within coils 3, 4 and inductively coupled therewith for inductively receiving energy discharged from capacitance 73. In turn, a complete electric circuit is formed by coil 5, capacitance 90, electrodes 104, and gap 102. Capacitance 90 uses the inductively received energy and oscillatively discharging the same via coil 5 and gap 102. Backplane further has mounting holes 93 circumferentially distributed thereon. Coils 3, 4 have leads 91, 92 respectively for coupling the capacitance 73.

A neutralized ion beam source is described in this invention which uses pulsed inductive electric fields to ionize a low pressure gas. The techniques of the present invention includes a pre-ionization scheme or method, wherein an axial valve of FIGS. 3–4, a nozzle 2, a tank circuit 77, and a modulator 6 are provided to improve the efficiency of the ionization and to produce a pulsed, high current, low emittance, neutralized ion beam that has a directed velocity, a controllable pulse shape and is fully ionized downstream from the source.

The ion source uses a high speed gas valve to inject a puff of gas through a nozzle 2 and into an annular volume 15 between two concentric driving coils. The driving coils are driven with an oscillating current pulse. The high rate of change in the current driven through the driving coils 3, 4 produces a rapidly rising magnetic field in the gas volume, inducing an azimuthal electric field in the gas in the order of, for example 100 V/cm. While the electric field initiates and drives a rapid breakdown of the gas into plasma, the rapidly changing magnetic field, produced by the current in the driving coils 3, 4, induces currents in the plasma and thereby accelerates the resulting plasma. Downstream from the driving coils 3, 4, a modulator 6, a pair of concentric coils 7, 8 placed so that the ion beam passes between them is used to control the pulse shape of the ion beam current. In an alternative embodiment, the gas valve may not be required; a static gas fill or flowing gas may be used.

The pulsed ion source of the present invention has inherent advantages compared with prior art sources, which use electrodes to generate the electric fields required to break down neutral gas into plasma or accelerate the ions. That is because electrodes have limited lifetime, may require cooling, and introduce impurities into the plasma. These impurities typically are strongly radiating species which dissipate energy, cool the plasma thereby preventing full ionization, and reduce the energy efficiency of the plasma source. These problems are greatly reduced by the present invention because the driving coils 3, 4 are electrically insulated from the plasma as there is no plasma current that connects to the driving coils 3, 4. Therefore, no impurities can originate from the insulated coils 3, 4.

The ionization process is initiated when seed electrons, accelerated by the inductive electric field, have ionizing collisions with a neutral gas. By way of example, an electric field, of the order of 100 V/cm is required for prompt initiation and completion of the ionization process. Since the ionization coil must have current driven in it to produce the changing magnetic flux that generates the inductive electric field, the higher that electric field must be or the longer it must be applied results in more energy that must be expended in the electric driving circuit. The high voltage on the ionization coil leads to high peak current which may far exceed the current needed in the discharge to drive the plasma to full ionization.

The seed electrons, needed for reproducible and prompt gas breakdown, can be created using a localized high magnitude electric field or thermal effects. Localized high magnitude electric fields can be generated from sharp edges of metal members, at a first electric potential, near a second electric potential. The source of the present invention uses a new device called a pre-ionization coil 5. This pre-ionization coil 5 is inductively coupled to the driving coils. The pre-ionization coil 5 is typically concentric with the coils but at a smaller radius. By placing a small spark gap in the pre-ionization coil 5, an electric field, with a magnitude many times that of the azimuthal field, is produced in the gap. This electric field generates seed electrons. To reduce total current through the gap, which could otherwise cause wear to the gap electrodes and emit impurities into the plasma as described earlier with regarding to related prior art methods and apparatus, a high impedance circuit element, such as a low capacitance capacitor 73, is connected in series with the gap. By placing the pre-ionization gap near the circumference of the driving coils, the seed electrons are emitted directly into the source gas in the breakdown region. This method reduces the inductive electric field required for prompt ionization of the neutral gas into plasma, and improves reproducibility of the breakdown.

To create the required electric and magnetic fields to break down a neutral gas and accelerate the resultant plasma, a large oscillating current is required. The energy required is proportional to the current squared times the inductance. If the power supply for this current, which can be a capacitor charged to the appropriate voltage in series with a switch, directly drives the ionization coils then this inductance is the sum of the inductance of the ionization coil, power feed and driver. In the present invention, in order to minimize the drive energy, low inductance switches and capacitors are necessary and the driver is connected to the coil using a short, low inductance feed.

To decrease the energy required and remove some of the constraints on the driver, the source uses a capacitor across the driving coils as a tank circuit. While tank circuits are known, the specifications and use of the circuit is novel. Note that the driving coils 3, 4 are part of the tank circuit 77 in that they provide the requisite inductance of the circuit 77. The tank circuit 77 is charged with one or more half sine waves from an external pulsed power supply. The capacitance of the tank circuit 77 needs to be harmonically tuned with the inductance of the driving coils 3, 4 to generate a pulse shape of a specific form. The current 60 through the driving coils 3, 4 then has the form of a large amplitude first half sine wave with a long period followed by smaller amplitude oscillations with a shorter period. The large initial amplitude provides the required electric fields necessary to break down the neutral gas into plasma while the higher frequency oscillations create the required magnetic field pulses that accelerate the ions. The energy for these oscillations is provided by the tank circuit. The tank capacitor 73 can be placed close to the coils so that the ratio of the ionization coil inductance to the total circuit inductance is near one for high efficiency. Alternatively, the pulsed power supply can have a higher inductance and be located at a convenient distance from the source without compromising efficiency.

High neutral gas density can cause degradation to the ion beam as a result of collisions between the steaming ions and neutrals. To prevent this, an ion source has to either operate under conditions which result in small collision cross sections such as using a very low background pressure of the supply gas, or use a localized supply 9 near the breakdown region. Also, the pressure in the breakdown region 15, which is in front of the driving coils, has an effect on the quality of the ion beam. Typical room temperature gas velocities are significantly lower than the directed velocity of the ion beam, so a pulsed or constant flow localized gas supply 9 located near the breakdown region 15 may be used. For this source, to provide the lowest downstream neutral gas density while still providing the correct neutral gas density in breakdown region 15, a special nozzle 2 was invented in the present invention to control the gas supply flow. The nozzle 2 uses a gas supply 9 located at the center of the driving coils. The gas is directed radially out from the center. Then the gas enters into a large reservoir in the shape of a cup. There is a small gap between the plane of the driving coils, which is a solid structure, and the end of the cup. The gas exits from the reservoir radially, passing in front of the driving coils. Using this nozzle 2 design, the gas flow moves perpendicular to the ion beam.

A constant flow gas supply may require more vacuum pumping than a pulsed gas supply to maintain low enough pressure for good propagation of the beam. Further, since the preferred embodiment uses a pulsed source, a constant gas supply is not required for the same. Another advantage for using a pulsed source is that the operating conditions of the gas density in front of the driving coils 3, 4 can be controlled by changing the timing from the opening of the valve to the start of the current pulse 60 in the driving coils 3, 4.

For the ion source of the present invention, a new modified fast needle valve (see FIG. 3) was invented to provide a uniform puff of gas. A pulsed magnetic field operates the valve. By way of an example, a half sine wave current pulse, of a peak of hundreds to thousands of amperes, is sent through a coil 33 above a metal disk 30 or plate. The current pulse width, and the conductivity and thickness of the disk 30, are selected such that the magnetic field produced by the coil 33 does not fully penetrate the disk 30 during the current pulse. As a result, the pulsed magnetic field accelerates the metal disk 30 away from the coil 33. Attached to the metal disk 30 is a needle. The needle is therefore accelerated away from its seat, thereby opening the valve. After the magnetic field pulse, the needle is pushed back by spring force, either from a spring 23 located under the disk 30 or by shaping the disk 30 conically in the form of a Belleville spring. The spring force keeps the valve sealed until the next magnetic field pulse. The mass of the needle and plate can be made sufficiently small, resulting in a large acceleration. If the current pulse is only tens of microseconds long and the metal disk 30 is only allowed thousandths of inches of motion, than the valve is only open for tens of microseconds. Behind the seat is a small plenum which is connected to a gas source. During the time the valve is open, most of volume of gas in the plenum escapes from the valve. Between the pulses, the plenum is refilled with gas. The size of the gas plenum and the pressure of the gas in the plenum can be adjusted to control the volume of gas released. Combined with the previously described nozzle, an annular gas puff with very good azimuthal uniformity can be produced. Obtaining good azimuthal uniformity has been a problem with prior art fast gas valves. To further improve the operation of the valve, an elastomer 24 may be used to absorb the kinetic energy in the metal disk 30 and prevent it from bouncing as it is closing. In other words, the impact of the metal disk 30 upon a third hard material member is impeded by the use of the elastomer 24.

The source as described to this point produces a pulse of streaming plasma with each pulse of the gas valve and driver coils. The ion current density transported by this streaming plasma pulse rises smoothly to a peak and then declines back to zero over the time of the pulse. The time duration of this pulse can be controlled by the characteristics of the driving coil waveform, but the output is always peaked in due time. For some applications, further control of the ion current density pulse shape may be required. In particular, for ion sources for particle accelerators, it is desired to produce a pulse with fast rise- and fall-time, and a very constant current density in between, i.e., a flat pulse. The present invention teaches a modulator for modulating the resultant ion current in that further shaping of the pulse is possible. In other words, the modulator provides further shaping of the pulse beyond what is obtainable with the driver coils alone.

The modulator operates by placing a pair of concentric modulator coils downstream of the breakdown region, positioned so that the plasma streams through the annular space between these modulator coils. A pulsed current waveform is imposed on the modulator coils, coinciding with the time during the passage of plasma through the plane of the coils. As the streaming plasma encounters the magnetic field produced by the modulator current, a current is induced in the conductive plasma, producing a magnetic force on the plasma in the direction which would repel the plasma axially away from the modulator, back toward the source. A large enough current in the modulator coils can essentially stop the plasma, but smaller current can attenuate the amount of plasma that passes through the modulator to exit downstream. The degree of attenuation is determined by the magnitude of the current in the modulator coils. Therefore, by choosing an optimal pulse shape for the magnitude of the modulator coil current, the attenuation of the plasma pulse can be controlled as a function of time throughout the pulse, thus controlling the shape of the plasma pulse transmitted to the exit.

The fundamental feature of this interaction of the neutralized ion beam, or plasma stream, with the modulator is that the plasma density and conductivity are high enough so that the plasma acts as a conductive, net charge-neutral medium. This is in distinction to the case of a bare, un-neutralized ion beam, which would interact very differently with the magnetic field of the modulator. In the case of the latter, each ion, as it passed through the modulator field, would simply be deflected at an angle to its original direction of flight. This does not happen with the streaming plasma source of the present invention because the co-moving electrons in the plasma are deflected in the opposite direction, producing charge separation and thereby generating an electrostatic field in the radial direction that tends to cancel the magnetic deflection of ions. This is known as polarization-drift propagation. Thus, by way of experiment, no net deflection of the beam exiting the modulator is observed in this source, only the current density is attenuated by an amount dependent on the modulator field strength. With an un-neutralized ion beam, a deflection proportional to the field strength would be produced. It is noted that the streaming plasma source avoids this deflection, which would have an unacceptable adverse affect on the ion optics of the source for critical applications such as high-energy ion accelerators.

In contrast to this prior art, the ion source described in this invention uses a magnetic field to control the ion current density in the plasma stream produced by the source, but this field operates on the plasma as a conductive medium, rather than as individual ions, and produces control of the ion current density without deflection, which is required for some applications.

The application of the present invention may comprise fusion energy related industries, semiconductor industries, nanotechnology related fields, material modification, such as hardening and smoothing, related industries, space propulsion related industries, etc.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A streaming plasma ion source, comprising:

a power supply;

a gas supply positioned upstream of the source;

a set of coils receiving power from the power supply for conveying an energy for ionization of a gas and acceleration of a resultant plasma, and being insulated from the plasma; and a pre-ionization coil, being a wire coil with a gap in series with a high impedance circuit element for receiving the energy for ionization.

2. The source of claim 1 further comprising a modulator for shaping of the resultant neutralized ion beam pulse, the modulator including a set of coils having electric current flowing therein.

3. The source of claim 1 further comprising a nozzle disposed at the proximity of the set of coils to create a reservoir for the gas subject to ionization.

4. The source of claim 1 further compromising a tank circuit comprising a capacitance positioned in parallel with the inductance of the set of coils for receiving a supply of energy and outputting the same for ionization and acceleration.

5. The source of claim 1 wherein the gas supply comprises a fast needle valve, using a current through a coil generating a pulsed magnetic field that does not fully penetrate a metallic plate connected to a stem thereby controlling the valve.

6. A streaming plasma ion source, comprising:

a power supply;

a gas supply position upstream of the source;

a set of coils receiving power from the power supply for conveying an energy for ionization of a gas and acceleration of the resultant plasma, and being insulated from the plasma; and a modulator for shaping of the resultant neutralized ion beam pulse, the modulator including a set of coils having electric current flowing therein.

7. The source of claim 6 further comprising a pre-ionization coil, being a wire coil with a gap positioned in series with a high impedance circuit element for receiving the energy for ionization.

8. The source of claim 6 further comprising a nozzle disposed at the proximity of the set of coils to create a reservoir for the gas subject to ionization.

9. The source of claim 6 further comprising a tank circuit comprising a capacitance positioned in parallel with the inductance of the set of coils for receiving a supply of energy and outputting the same for ionization and acceleration.

10. The source of claim 6 wherein the gas supply comprises a fast needle valve, which uses a current through a coil generating a pulsed magnetic field being free from fully penetrating a metallic plate connected to the needle, thereby controlling the valve.

11. A streaming plasma ion source, comprising:

a power supply;

a gas supply position upstream of the source wherein the gas supply comprises a fast needle valve, which uses a current through a coil generating a pulsed magnetic field being free from fully penetrating a metallic plate connected to a stem thereby controlling the valve; and a set of coils receiving power from the power supply for conveying an energy for ionization of a gas and accelerating a resultant plasma, and being insulated from the plasma.

12. The source of claim 11 further comprising a modulator for shaping of the resultant neutralized ion beam pulse, the modulator including a set of coils having electric current flowing therein.

13. The source of claim 11 further comprising a nozzle disposed at the proximity of the set of coils to create a reservoir for a gas subject to ionization.

14. The source of claim 11 further comprising a tank circuit comprising a capacitance positioned in parallel with an inductance of the set of coils for receiving a supply of energy and outputting the same for ionization and acceleration.

15. The source of claim 11 further comprising a pre-ionization coil, a wire coil with a gap positioned in series with a high impedance circuit element for receiving an energy for ionization.

16. A streaming plasma ion source, comprising:

a power supply;

a gas supply being positioned upstream of the source, wherein the gas supply comprises a fast needle valve, which uses a current through a coil generating a pulsed magnetic field that is free from fully penetrating a metallic plate connected to a stem thereby controlling the valve;

a set of coils receiving power from the power supply for conveying an energy for ionization of a gas and acceleration of the resultant plasma, and being insulated from the plasma;

a modulator for shaping of the resultant neutralized ion beam pulse, the modulator including a set of coils having electric current flowing therein;

a nozzle disposed at the proximity of the set of coils to create a reservoir for a gas subject to ionization;

a tank circuit comprising a capacitance in parallel with the inductance of the set of coils for receiving a supply of energy and outputting the same for ionization and acceleration; and a pre-ionization coil being a wire coil with a gap positioned in series with a high impedance circuit element for receiving the energy for ionization.

* * * * *